US008844806B2

(12) United States Patent
Miller

(10) Patent No.: US 8,844,806 B2
(45) Date of Patent: Sep. 30, 2014

(54) SELECTIVE BUNCH PRESENTATION

(71) Applicant: NCR Corporation, Duluth, GA (US)

(72) Inventor: Alexander P. Miller, Dundee (GB)

( * ) Notice: Subject to any disclaimer, the term of this patent is extended or adjusted under 35 U.S.C. 154(b) by 0 days.

(21) Appl. No.: 13/719,544

(22) Filed: Dec. 19, 2012

(65) Prior Publication Data

US 2014/0166684 A1 Jun. 19, 2014

(51) Int. Cl.

| | |
|---|---|
| ***G06Q 40/00*** | (2012.01) |
| ***B65H 5/22*** | (2006.01) |
| ***B65H 3/44*** | (2006.01) |

(52) U.S. Cl.

CPC ..... *B65H 3/44* (2013.01)
USPC ..... 235/379; 235/381; 705/43; 271/3.01

(58) Field of Classification Search

CPC .... G07D 11/0024; G07F 19/20; G07F 20/203
USPC ..... 235/379, 381; 705/43; 902/8–9; 271/3.01
See application file for complete search history.

(56) References Cited

U.S. PATENT DOCUMENTS

| | | | | |
|---|---|---|---|---|
| 2007/0034683 | A1* | 2/2007 | Eastman et al. | 235/379 |
| 2010/0025911 | A1* | 2/2010 | Sakamoto | 271/3.01 |

* cited by examiner

*Primary Examiner* — Michael G Lee
*Assistant Examiner* — Laura Gudorf
(74) *Attorney, Agent, or Firm* — Joseph P. Merhle

(57) ABSTRACT

The present invention provides a method and apparatus for presenting a bunch of items of media to a user of a Self-Service Terminal (SST). The method comprises individually removing at least one item of media from at least two respective media item containers in a predetermined sequence responsive to at least one common predetermined characteristic of each item of media, providing the removed items of media as a bunch of items of media, and presenting the bunch of items of media to a user.

11 Claims, 5 Drawing Sheets

SELECTIVE BUNCH PRESENTATION

FIELD OF THE INVENTION

The present invention relates to presenting a bunch of items of media to a user. In particular, but not exclusively, the present invention relates to a method and apparatus for selectively arranging items of media, such as currency notes, into a bunch in an order responsive to a common characteristic (such as the size) of each item of media and presenting the bunch to a user of a Self-Service Terminal (SST), such as an Automated Teller Machine (ATM).

Known SSTs include a media dispenser which dispenses items of media to a user of the SST. Items of media include bank notes, checks, stamps and coupons, for example. Two known types of dispenser are spray dispensers which dispense items of media individually into a tray and bunch dispensers where items of media are collected together in a bunch which is presented to a user of the SST. A known banknote dispenser of an ATM, for example, includes a removable currency cassette, a pick unit for removing individual banknotes from the cassette, a transport unit for conveying picked banknotes, a stacker wheel or ballistic stacker for collating picked banknotes into a bunch, a presenter unit for presenting the bunch of picked and collated banknotes to a user of the ATM, and a controller for controlling the operation of the dispenser. All these components are housed in a chassis of the ATM.

However, bank notes are typically removed from the currency cassette and collated into a bunch in no particular order of currency value or size. For example, for a 50 Euro transaction, a 10 Euro banknote may be picked and collated into a bunch to sit between two larger 20 Euro banknotes and thereby be hidden from view when a user of the ATM removes the bunch from the dispenser. Alternatively, smaller sized notes may on occasion be pinched whereby they are hidden from a user, who takes the bunch, by adjacent larger notes. Furthermore, a bunch may contain different types of items of media having different characteristics, such as a bunch containing a glossy voucher and a number of relatively rough banknotes. Presenting such a bunch to a user with a glossy voucher at the top or bottom of the bunch can cause the voucher to slip away from the bunch before or after removal from the dispenser. Furthermore, the user can find it difficult to remove the bunch from the dispenser in light of the glossy and relatively slippy voucher on the outside of the bunch. Furthermore, the dispenser itself can find it difficult to pinch, dispense and/or retract a bunch in light of the glossy and relatively slippy voucher on the outside of the bunch. Alternatively, a bunch may contain relatively heavy banknotes and a lightweight coupon, for example. If the coupon is picked and collated to be on top of a presented bunch, it is susceptible to blowing way in the wind.

A known attempt to force a desired picking order is to selectively program the controller to a particular picking and collating sequence. However, if a different bunch order is desired, the controller must be reprogrammed. This is a complex, time consuming and error prone task and, as a result, is often not attempted.

SUMMARY OF THE INVENTION

It is an aim of the present invention to at least partly mitigate the above-mentioned problems.

It is an aim of certain embodiments of the present invention to selectively arrange items of media into a bunch in an order responsive to a common characteristic of each item of media before presenting the bunch to a user.

It is an aim of certain embodiments of the present invention to selectively arrange items of media into a bunch in an order responsive to a configuration of a dispenser before presenting the bunch to a user.

It is an aim of certain embodiments of the present invention to pinch items of media in an order that is determined by a way in which a resulting bunch should advantageously be presented to a user.

According to a first aspect of the present invention there is provided apparatus for presenting a bunch of items of media to a user, comprising:

- a plurality of media item containers each containing a respective plurality of items of media having at least one common predetermined characteristic; and
- a controller configured to control at least one pick unit to selectively remove at least one item of media from at least two media item containers in a predetermined sequence responsive to the at least one common predetermined characteristic of each item of media.

Aptly, the at least one common predetermined characteristic comprises at least one dimension of each item of media.

Aptly, the at least one dimension comprises an edge length of each media item.

Aptly, the predetermined sequence comprises individually removing at least two sheet-like items of media from respective containers in an order respective to a planar area of each item of media, wherein the item of media having a largest planar area is removed first.

Aptly, the predetermined sequence comprises individually removing at least two sheet-like items of media from respective containers in an order respective to a planar area of each item of media, wherein the item of media having a smallest planar area is removed first.

Aptly, the apparatus further comprises:

- at least one pick unit for individually removing at least one item of media from a respective media item container;
- a stacker unit for collating picked items of media into a bunch of items of media;
- a presenter unit for presenting the bunch of items of media to a user;
- a first transporter unit for transporting the picked items of media from the at least one pick unit to the stacker unit; and
- a second transporter unit for transporting the bunch of items of media from the stacker unit to the presenter unit.

Aptly, the controller is configured to determine the common predetermined characteristic of the items of media and control the at least one pick unit accordingly.

Aptly, the controller is configured to determine a configuration of the presenter unit with respect to the stacker unit and control the at least one pick unit accordingly.

Aptly, a transport path along which the bunch of items of media is conveyed inverts between the stacker unit and the presenter unit to thereby invert the bunch of items of media being conveyed.

Aptly, the presenter unit and stacker unit are configured on the same side of the apparatus and an orientation of the bunch of items of media is adjusted after exiting the stacker unit and before the presenter unit relative to a path along which the bunch is conveyed.

According to a second aspect of the present invention there is provided a Self-Service Terminal (SST) comprising apparatus comprising:

a plurality of media item containers each containing a respective plurality of items of media having at least one common predetermined characteristic; and a controller configured to control at least one pick unit to selectively remove at least one item of media from at least two media item containers in a predetermined sequence responsive to the at least one common predetermined characteristic of each item of media.

Aptly, the plurality of media item containers are removably loadable from a front side of the SST relative to a user interface of the SST, and wherein the predetermined sequence comprises individually removing at least two sheet-like items of media from respective containers in an order respective to a planar area of each item of media, wherein the item of media having a largest planar area is removed first.

Aptly, the plurality of media item containers are removably loadable from a rear side of the SST relative to a user interface of the SST, and wherein the predetermined sequence comprises individually removing at least two sheet-like items of media from respective containers in an order respective to a planar area of each item of media, wherein the item of media having a smallest planar area is removed first.

Aptly, a transport path along which the items of media are conveyed after being picked inverts before the items of media are presented to a user.

Aptly, the SST further comprises:

at least one pick unit for individually removing at least one item of media from a respective media item container;

a stacker unit for collating picked items of media into a bunch of items of media;

a presenter unit for presenting the bunch of items of media to a user;

a first transporter unit for transporting the picked items of media from the at least one pick unit to the stacker unit; and a second transporter unit for transporting the bunch of items of media from the stacker unit to the presenter unit.

Aptly, the at least one pick unit comprises a pivoting pick arm coupled to a pick unit motor operatively coupled to the controller;

the stacker unit comprises a stacker wheel or ballistic stacker operatively coupled to the controller; and the first transporter unit comprises a vertical portion for receiving picked items of media and a horizontal portion for conveying the picked items of media to the stacker unit.

Aptly, a transport path along which the bunch of items of media is conveyed inverts between the stacker unit and the presenter unit to thereby invert the bunch of items of media being conveyed.

Aptly, the plurality of items of media comprises one or more of a currency note, voucher, coupon or stamp.

According to a third aspect of the present invention there is provided a method of presenting a bunch of items of media to a user, comprising:

individually removing at least one item of media from at least two respective media item containers in a predetermined sequence responsive to at least one common predetermined characteristic of each item of media;

providing the removed items of media as a bunch of items of media; and presenting the bunch of items of media to a user.

Aptly, the method further comprises determining if a transport path along which the bunch of items of media is conveyed inverts before the bunch is presented to a user.

Aptly, the method further comprises adjusting the predetermined sequence in response to the step of determining if a transport path along which the bunch of items of media is conveyed inverts before the bunch is presented to a user.

Aptly, the method further comprises determining if the media item containers are loadable into a proximal or distal side of a media dispenser in which the containers are disposed relative to a user.

Aptly, the method comprises adjusting the predetermined sequence in response to the step of determining if the media item containers are loadable into a proximal or distal side of a media dispenser in which the containers are disposed relative to a user.

Aptly, the media item containers are loadable into the front of the media dispenser and the predetermined sequence comprises individually removing at least two sheet-like items of media from respective containers in an order respective to a planar area of each item of media, wherein the item of media having a largest planar area is removed first.

Aptly, the media item containers are loadable into the rear of the media dispenser and the predetermined sequence is reversed.

Aptly, the predetermined sequence comprises individually removing at least two sheet-like items of media from respective containers in an order respective to a planar area of each item of media, wherein the item of media having a smallest planar area is removed first.

According to a fourth aspect of the present invention there is provided a method of picking items of media stored in a self-service terminal (SST), comprising:

picking items of media, responsive to a sensed condition, either:

i) in a configurable pick sequence; or ii) in a default pick sequence.

Aptly, the configurable pick sequence is determined responsive to a common predetermined characteristic of each item of media.

Aptly, the default pick sequence is a default pick sequence of the SST.

Aptly, the sensed condition is a state of a manual override flag.

Aptly, if the manual override flag is set, items of media are picked in the configurable pick sequence.

Aptly, if the manual override flag is not set, items of media are picked in the default pick sequence.

Aptly, the configurable pick sequence is selectively input by a configuration tool.

Aptly, the configuration tool comprises a Windows™ Registry and/or configuration applet.

According to a fifth aspect of the present invention there is provided a method of presenting a bunch of items of media to a user, comprising:

providing at least two media item containers wherein each contains a plurality of respective items of media;

determining a sequence in which to individually remove at least one item of media from a respective media item container responsive to at least one common predetermined characteristic of each item of media;

individually removing at least one item of media from at least two respective media item containers responsive to the predetermined sequence;

providing the removed items of media as a bunch of items of media; and presenting the bunch of items of media to a user.

Aptly, the method further comprises determining if a transport path along which the bunch of items of media is conveyed inverts before the bunch is presented to a user.

Aptly, the method further comprises adjusting the predetermined sequence in response to the step of determining if a transport path along which the bunch of items of media is conveyed inverts before the bunch is presented to a user.

Aptly, the method further comprises determining if the media item containers are loadable into a proximal or distal side of a media dispenser in which the containers are disposed relative to a user.

Aptly, the method further comprises reversing the predetermined sequence for individually removing at least one item of media from a respective media item container.

Aptly, the predetermined sequence is either:

i) a configurable pick sequence determined responsive to a common predetermined characteristic of each item of media; or ii) a default pick sequence;

and is selected responsive to a sensed condition; wherein the sensed condition is a state of a manual override flag; and if the manual override flag is set, items of media are picked in the configurable pick sequence, and if the manual override flag is not set, items of media are picked in the default pick sequence.

According to a sixth aspect of the present invention there is provided a method of presenting a bunch of items of media to a user, comprising:

selecting a plurality of items of media in a predetermined sequence responsive to at least one common predetermined characteristic of each item of media;

collating the selected items of media into a bunch of items of media; and presenting the bunch of items of media in a desired orientation to a user.

According to a seventh aspect of the present invention there is provided a configuration program for use with a self-service terminal dispenser, the configuration program comprising:

a user interface operable to present a user with a plurality of media picking options, wherein one media picking option relates to a default media picking algorithm, and another media picking option relates to a configurable media picking algorithm.

The configuration program may include the default media picking algorithm and the programmable media picking algorithm. Alternatively, the default media picking algorithm and the programmable media picking algorithm may be provided in firmware on the self-service terminal dispenser. Where the algorithms are stored on the self-service terminal dispenser, the configuration program may communicate parameters to a controller in the self-service terminal dispenser, where the communicated parameters indicate which algorithm is to be used, and/or how the controller can configure the programmable media picking algorithm.

The user interface may provide a user with a menu listing a plurality of characteristics of media items, such that the user can select the characteristic or characteristics to be used in selecting a pick order of media items.

Certain embodiments of the present invention provide the advantage that items of media may be selectively arranged into a bunch in an order responsive to a common characteristic of each item of media before presenting the bunch to a user of a SST.

Certain embodiments of the present invention provide the advantage that an item of media having a particular characteristic with respect to other items of media being picked may be selectively positioned within a bunch before the bunch is presented to a user of a SST.

Certain embodiments of the present invention provide the advantage that a configuration of a stacker unit with respect to a present unit in a media dispenser may be determined and items of media can be picked and collated in response to the configuration before a bunch is presented to a user of a SST.

Certain embodiments of the present invention provide the advantage that an authorized user of a SST may selectively input a desired picking sequence response to a desired common predetermined characteristic of each item of media to provide a bunch of items of media to a user of the SST in a desired order.

BRIEF DESCRIPTION OF DRAWINGS

Embodiments of the present invention will now be described hereinafter, by way of example only, with reference to the accompanying drawings in which.

DESCRIPTION OF EMBODIMENTS

Figure 1:
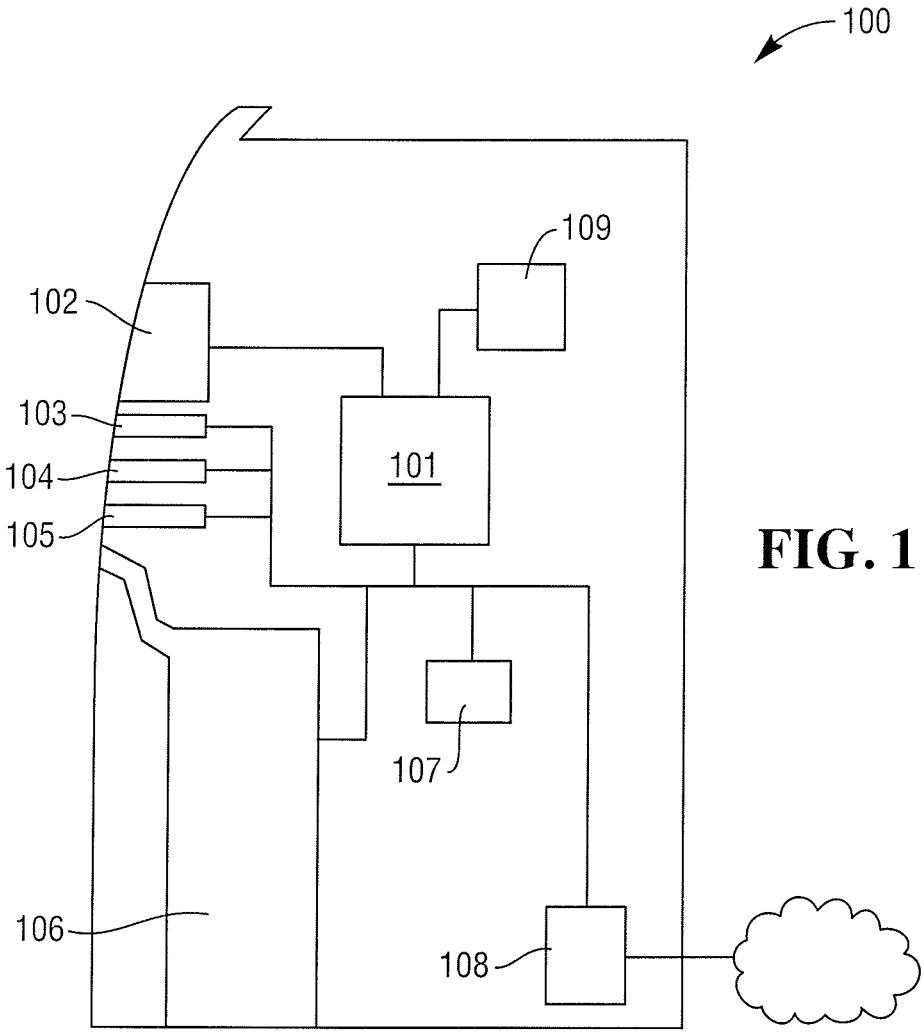
FIG. 1 illustrates a schematic of a Self-Service Terminal (SST) such as an ATM.

In the drawings like reference numerals refer to like parts.

FIG. 1 illustrates a block diagram of a Self-Service Terminal 100 in the form of an automated teller machine (ATM) according to one embodiment of the present invention. It will be understood that certain embodiments of the present invention are applicable to other types of terminal such as ATMs, vending machines and the like.

The ATM 100 includes different modules for enabling transactions to be executed and recorded by the ATM 100. These ATM modules include user transaction modules and service personnel modules. The ATM modules include an ATM controller 101, a user display 102, a card reader/writer module 103, an encrypting keypad module 104, a receipt printer module 105, a cash dispenser module 106, a journal printer module 107 for creating a record of every transaction executed by the ATM, a connection module 108, an operator panel module 109 for use by an authorized user of the SST, such as a service operator, field engineer, a replenisher (of currency, of printed paper or the like), or the like.

Certain user transaction modules (such as the ATM controller 101) are also used by the authorized service personnel for implementing management functions. However, some of the modules are referred to herein as service personnel modules (such as the journal printer module 107 and the operator panel module 109) because they are never used by ATM users.

Figure 2:
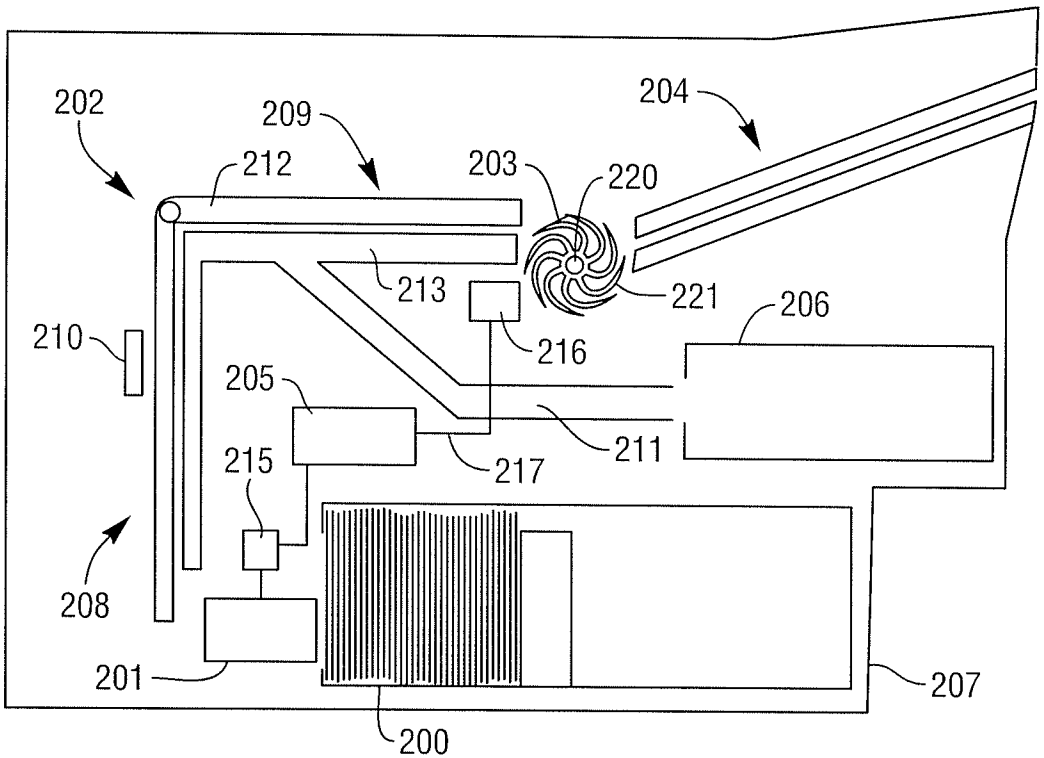
FIG. 2 illustrates a schematic diagram of a media dispenser such as a currency note dispenser.

FIG. 2 illustrates a schematic diagram of an ATM media dispenser 100. The ATM 100 includes a number of removable currency cassettes 200 each containing a respective value of currency note.

The ATM further includes a pick unit 201 which operates to remove individual bank notes from a currency cassette 200, a transport section 202 for transporting picked bank notes, a stacker wheel 203 for collating picked bank notes into a bunch of bank notes (instead of a stacker wheel a ballistic stacker or the like could be used). A presenter unit 204 presents a bunch of picked and collated bank notes to a user of the ATM. A controller 205 controls the operation of the dispenser 100 and a purge bin 206 stores incorrectly picked bank notes or bank notes not removed by a user. These component parts are housed within a chassis 207.

Each currency cassette 200 typically includes a switch (magnetic or electronic) that indicates a characteristic, e.g. value and/or size, of the currency stored therein. A look-up table, or the like, which stores dimensions (or other characteristics) of currency notes may be provided for the controller 205 to access to ascertain what order to pick currency notes in. An individual cassette's contents can therefore be identified so the cassettes 200 may, for example, be arranged in any order in the dispenser 100. Such switches and/or look-up table may of course apply to other types of self-service terminal (SST) and media item.

The transport section 202 includes a vertical portion 208 for receiving a picked bank note from the pick unit 201 and a horizontal portion 209 for conveying a picked bank note either to the stacker wheel 203 or the purge bin 206. The vertical portion 208 includes a conventional bank note thickness sensor 210 to detect multiple superimposed bank notes being transported erroneously as a single bank note. Any such superimposed bank notes may have to be diverted to the purge bin 206 via a divert path 211. The horizontal portion 209 comprises an upper guide 212 which is pivotably coupled to a lower guide 213 to permit access to any bank notes jammed there between so that the jammed bank note can be removed therefrom. The lower guide 213 includes a diverter (not shown) for routing a bank note (or multiple bank notes) to the divert path 211.

The transport section includes various belts and/or gears to transport bank notes or other such currency notes and these belts and/or gears are all powered by a pick motor 215. The stacker wheel 203 is coupled to a stacker wheel motor 216. The stacker wheel motor 216 is coupled to the controller 205 by a control line 217.

The stacker wheel 203 comprises an axle 220 on which are mounted a plurality of mutually coupled but axially separated hubs (only one of which is shown in FIG. 2). Each hub includes a plurality of arcuate tines 221 disposed transverse to the axle on which the hubs are mounted. The hubs are mounted in registration so that the arcuate tines on one hub are aligned with the corresponding arcuate tines on all other hubs.

The hubs are rotated in unison as bank notes are fed towards the stacker wheel from the transport section. The rotation of the stacker wheel is synchronized with the speed at which bank notes are conveyed so that only one bank note is stored between adjacent tines on a hub.

Conventionally, based on a user request, individual bank notes are picked from a number of currency cassettes 200 each containing a respective value of bank note. For example, if a user requests a transaction of £60, the pick unit 201 may be controlled to remove three £20 notes from a respective cassette. Alternatively, if the cassette containing £20 notes is depleted, the pick unit may be controlled to pick a combination of £20, £10 and/or £5 notes or a required number of a single bank note value to make up a total of £60. This is to meet a target of emptying all currency cassettes at the same time. The stacker unit then collates the picked notes for the presenter unit to present to the user of the ATM in the form of a bunch of bank notes. The total requested by a user of the ATM and the amount of available bank notes in a respective container are thus important control factors of a conventional dispenser.

Figure 3:
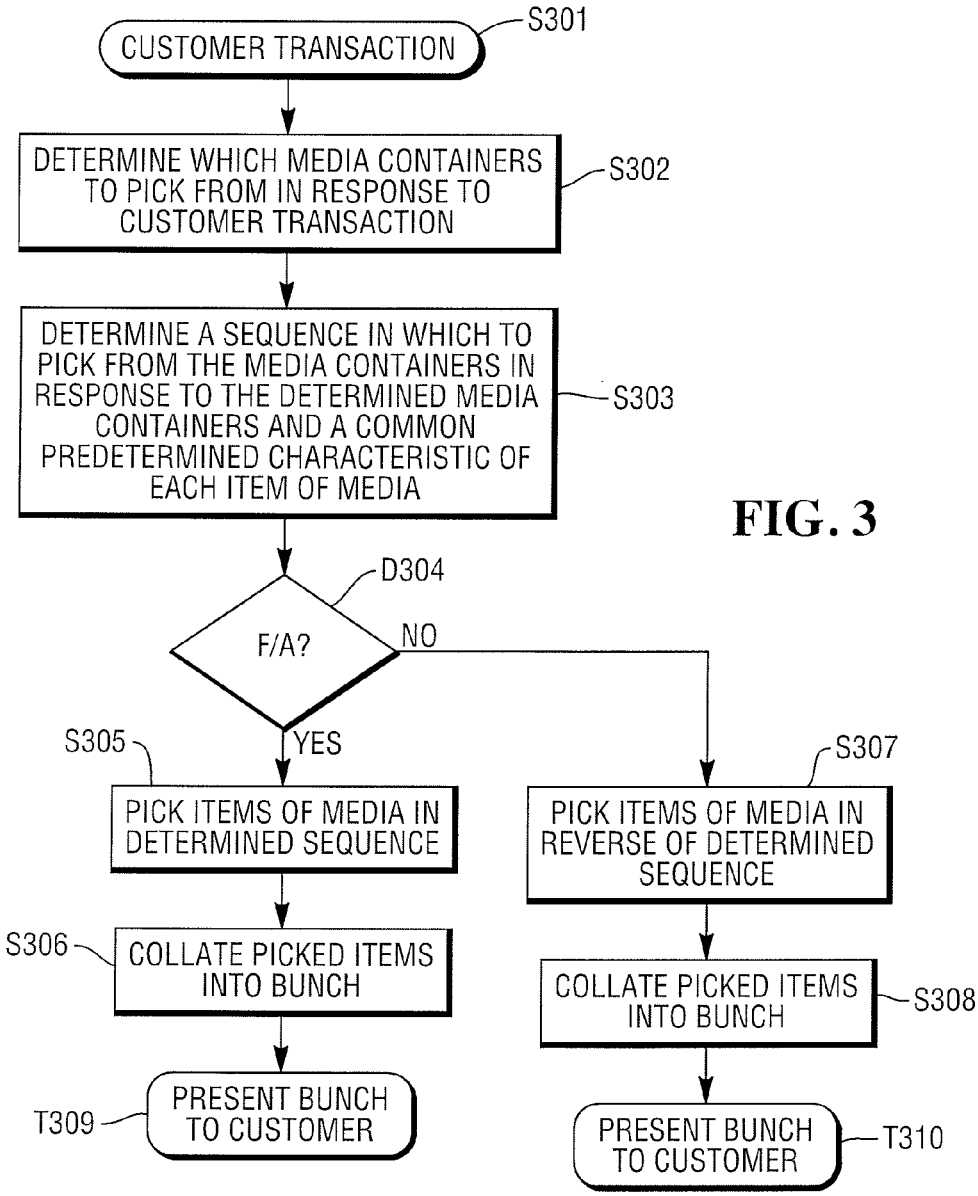
FIG. 3 illustrates a flow diagram showing a method according to an embodiment of the present invention for selectively presenting a bunch of currency notes to a user of a SST.

FIG. 3 illustrates a flow diagram showing the operation of a dispenser in accordance with the present invention. With reference also to FIGS. 1 and 2, a user of the ATM inputs a desired transaction (as shown by the start command S301) such as £60, via the user display 102 of an ATM 100. The controller 205 determines from which currency cassettes 200 individual bank notes must be picked from to meet the transaction requested by the user (step S302). The controller 205 then determines in which sequence the pick unit 201 must pick the bank notes from the respective cassettes 200 in response to a common predetermined characteristic of each bank notes in the cassettes 200 (step S303).

In this example, the items of media are currency notes which are sheet-like items of media each having a planar area. An aim of certain embodiments of the present invention is to pick and collate currency notes in a sequence which is responsive to the planar area of each currency note being picked thereby to present a bunch of currency notes to the user of the ATM in order of planar area wherein the currency note having the greatest planar area is disposed at the bottom of the bunch. This provides the advantage that all the currency notes in the bunch are visible to the user before, during and after removal from the presenter unit 204 and that the bunch is easier to remove from the presenter unit 204. Such an ordered bunch is also easier to place in a wallet, for example, and allows each note to be easily visible and removed from a wallet when required.

Of course, one or more other desired common characteristic of each item of media may be chosen, such as value, edge length, weight, color, texture, shape, size, type or form etc. The ATM may include suitable sensing or detection equipment to monitor operating conditions of the ATM and/or to determine a characteristic of each item of media before the sequence for picking and collating the same is determined by the controller. Telemetry may be collected over a period of time to provide more information to the controller thereby to dynamically refine the presentation order to increase reliability. For example, other media such as stamps or coupons may be relatively slippery compared to other media in a bunch and therefore it may be desirable to place such media in the middle of the bunch to ensure the same can be presented efficiently. Telemetry, for example, may also be used to determine when parts wear on a particular dispenser and the pick sequence may be adapted automatically to override a default behavior of the ATM to increase reliability. For example, it may be automatically or manually determined from operation data, including for example error reports, that the bunch presentation may be more likely to jam if the smallest media item is on the top of the bunch. Rather than taking the device completely out of service and waiting for maintenance, the pick sequence may be modified to ensure the ATM/dispenser stays in service until the maintenance can be scheduled.

ATMs typically offer two configurations depending on whether the cassettes 200 are replenished and maintained from the front (user side) or rear of the ATM. A front-loading ATM is typically known as front-access (F/A) and a rear-loading ATM is typically known as rear-access (R/A). Typical usage of a F/A ATM is free-standing against a wall inside a building and typical usage of a R/A ATM is through a wall into a street.

Figure 4:
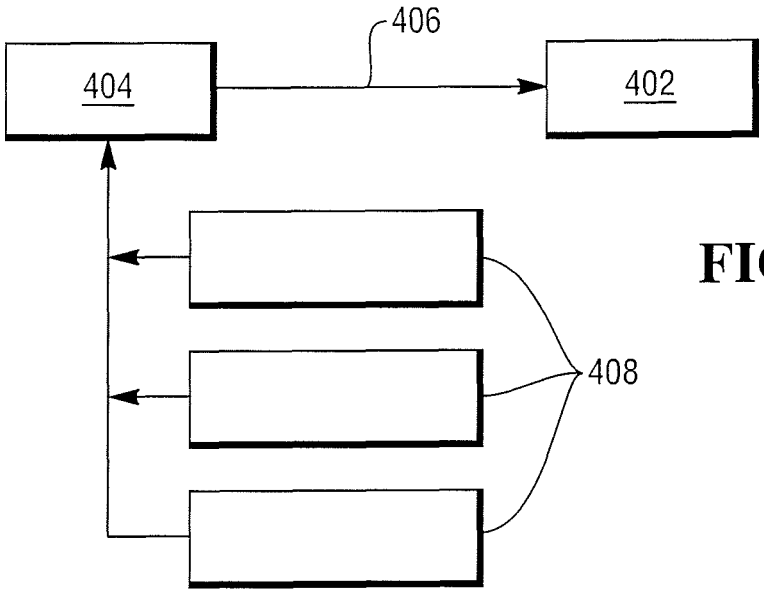
FIG. 4 illustrates a block diagram of a front access SST.

As illustrated in FIG. 4, a dispenser 400 includes a number of currency cassettes 408, a picker unit (not shown) for individually removing currency notes from the media cassettes 408, a stack unit 404 for collating the picked currency notes into a bunch, a presenter unit 402 for presenting the bunch to a user of the ATM and a transport unit 406 for conveying the bunch from the stacker unit 404 to the presenter unit 402. The presenter unit 402 of a F/A ATM is typically disposed on an opposite side of the dispenser to the stacker unit 404. Therefore, the orientation of a transport path along which the bunch of currency notes is conveyed on the transport unit 406 from the stacker unit 404 to the presenter unit 402 remains the same.

Figure 5:
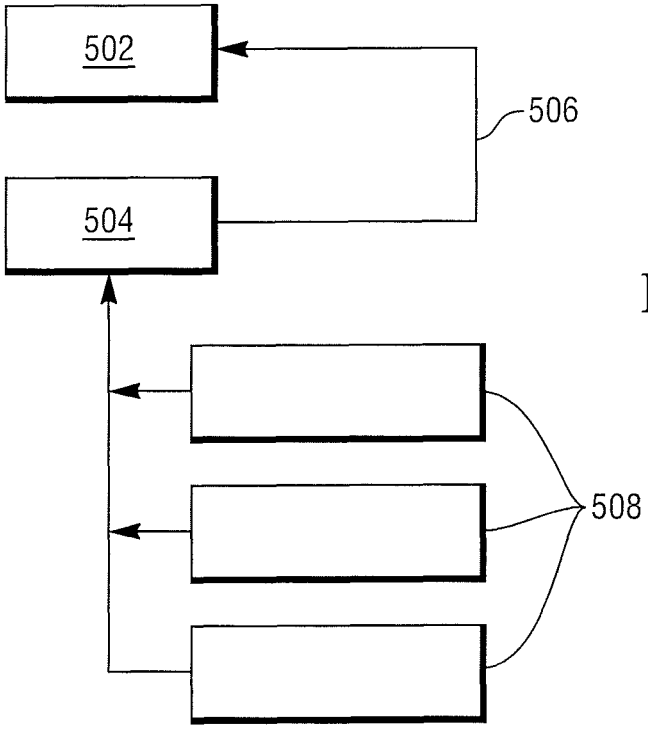
FIG. 5 illustrates a block diagram of a rear access SST.

As illustrated in FIG. 5, the presenter unit 502 of a R/A ATM is typically disposed on the same side of the dispenser as the stacker unit 504. Therefore, the orientation of a transport path along which the bunch of currency notes is conveyed on the transport unit 506 from the stacker unit 504 to the presenter unit 502 inverts. This in turn inverts the bunch of currency notes being conveyed from the stacker unit 504 to the presenter unit 506.

As illustrated in FIG. 3, with reference also to FIG. 2, after the controller has determined in which sequence the pick unit 201 must pick the currency notes from the respective cassettes 200 (step S303), it then determines if the self-service terminal, e.g. an ATM, is front (F/A) or rear (R/A) access (see decision D304). If the ATM is F/A, the currency notes are picked from respective cassettes in the determined sequence (step S305), before being collated into a bunch by the stacker unit (step S306). The bunch is then conveyed along a transport path to the presenter unit for presenting to the user of the ATM (see termination T309).

If the ATM is R/A, the currency notes are picked from respective cassettes in reverse of the determined sequence (step S307), before being collated into a bunch by the stacker unit (S308). The transport path between the stacker unit and the presenter unit of the R/A ATM inverts, as shown in FIG. 5, so the bunch, which was originally picked in reverse sequence, is presented to the user in a desired orientation (T310), such as a largest currency note on the bottom of the bunch to a smallest currency note at the top of the bunch. Such a bunch would make all notes in the bunch visible to the user of the ATM and would also make removing the bunch from the presenter unit easier for the user.

Alternatively, the controller may determine if the self-service terminal, e.g. an ATM, is front (F/A) or rear (R/A) access (that is to say if a transport path includes an invert section) before one or both of steps S302 and S303, such as on start-up of the SST. Additionally, if a dispenser is re-configured from F/A to R/A during use, for example, then the controller senses this change and adapts the pick sequence accordingly.

Figure 6:
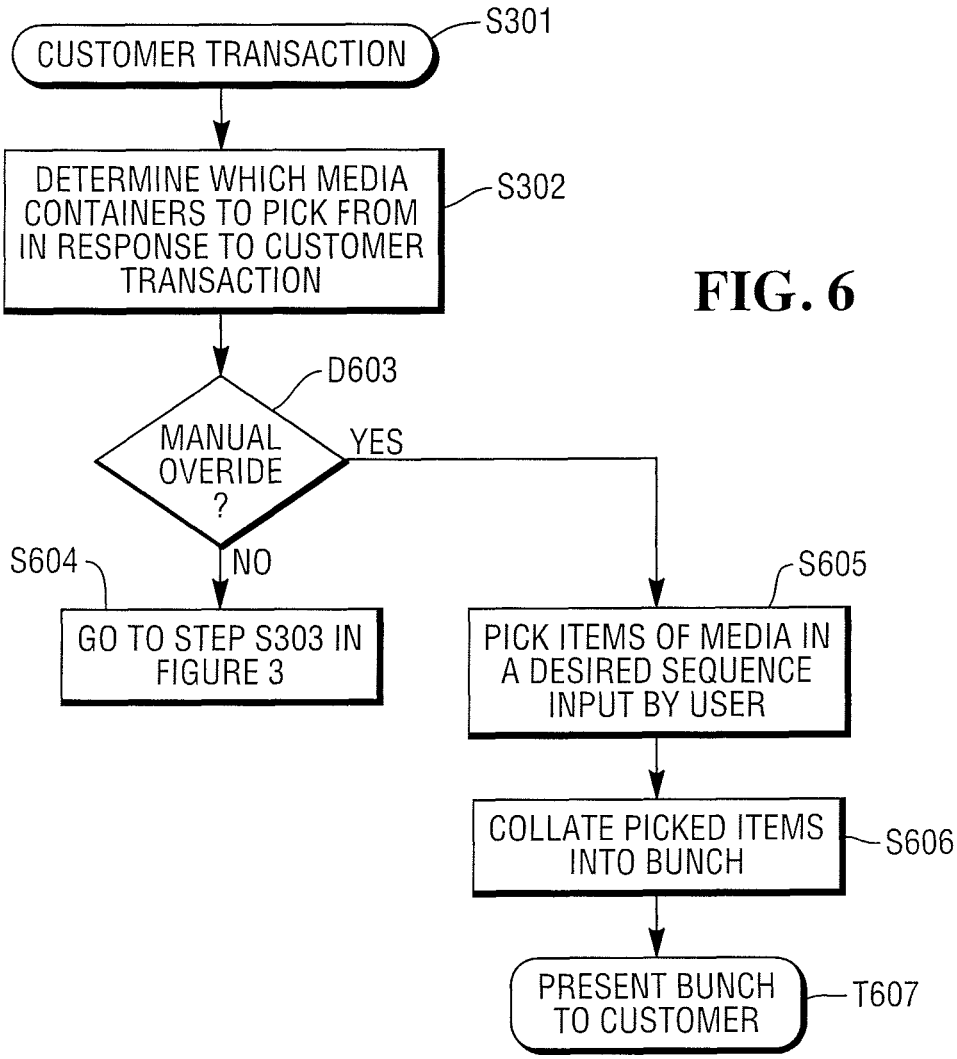
FIG. 6 illustrates a flow diagram of an alternative embodiment of the present invention.

As illustrated in FIG. 6, a desired picking sequence may be input manually to meet the requirements of a particular authorized user of the ATM, such as a bank or similar institution, to override a pre-set or default picking sequence of the ATM, which may for example be a factory default picking sequence or a picking sequence according to the process of FIG. 3. When a dispenser is installed in an ATM for example, drivers are generally loaded into the operating system and the Windows™ Registry can be configured with certain parameters. These parameters can be changed to alter the settings of the dispenser. In accordance with the present invention, one of the Registry settings may be used to manually override a 'normal' operating mode of the controller thereby to pick currency notes, and/or other media items, in a desired sequence and to present a bunch of such media items to a user of the ATM in a desired order. Aptly, the Windows™ Registry may be used to select such a manual override by, for example, setting a manual override flag. Alternatively, a suitable configuration applet could be used to configure a desired picking sequence or picking algorithm which would enable an authorized user of the ATM, such as a bank, to choose the characteristic of each item of media that is being used to determine a configurable picking sequence, e.g. media item thickness, planar area, etc., and to change the characteristic used at the ATM itself (by executing the configuration applet).

For example, instead of picking items of media in a sequence responsive to media item size, a bank may wish to always dispense a 5 Euro currency note in the middle of a bunch of dispensed currency notes. In this case, after step S302, the controller may determine if a manual override flag has been set at decision D603, i.e. if a desired sequence responsive to a desired common characteristic of each currency note has been input by the bank. If not, the process according to a default pick sequence, e.g. as shown in FIG. 3, is followed by going to step S303 thereof (at step S604 in FIG. 6). However, if a manual override flag has been set, the items of media are picked in accordance with the authorized user's requirements (at step S605). The items of media are then collated into a bunch (at step S606) and then presented to a user of the ATM (at termination T607). Similarly, if there are no differences in the physical aspect of each item of media, e.g. currency note, which would otherwise dynamically determine the pick sequence, then the order may be determined dynamically based on another characteristic of each currency note, such as value. For example, all US notes are the same size, so the smaller denomination currency notes could be placed on the top of the bunch, if desired by an authorized user.

Throughout the description and claims of this specification, the words "comprise" and "contain" and variations of them mean "including but not limited to" and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of the features and/or steps are mutually exclusive. The invention is not restricted to any details of any foregoing embodiments. The invention extends to any novel one, or novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

What is claimed is:

1. A method of presenting a bunch of items of media to a user, comprising:

individually removing at least one item of media from at least two respective media item containers in a predetermined sequence responsive to at least one common predetermined characteristic of each item of media, wherein the predetermined sequence is either:

i) a configurable pick sequence determined responsive to a common predetermined characteristic of each item of media; or ii) a default pick sequence;

and is selected responsive to a sensed condition; wherein the sensed condition is a state of a manual override flag; and if the manual override flag is set, items of media are picked in the configurable pick sequence, and if the manual override flag is not set, items of media are picked in the default pick sequence;

providing the removed items of media as a bunch of items of media; and presenting the bunch of items of media to a user.

2. The method as claimed in claim 1, further comprising determining if a transport path along which the bunch of items of media is conveyed inverts before the bunch is presented to a user.

3. The method as claimed in claim 2, further comprising adjusting the predetermined sequence in response to the step of determining if a transport path along which the bunch of items of media is conveyed inverts before the bunch is presented to a user.

4. The method as claimed in claim 1, further comprising determining if the media item containers are loadable into a proximal or distal side of a media dispenser in which the containers are disposed relative to a user.

5. The method as claimed in claim 4, wherein the media item containers are loadable into the front of the media dispenser and the predetermined sequence comprises individually removing at least two sheet-like items of media from respective containers in an order respective to a planar area of each item of media, wherein the item of media having a largest planar area is removed first.

6. The method as claimed in claim 4, wherein the media item containers are loadable into the rear of the media dispenser and the predetermined sequence is reversed.

7. Apparatus for presenting a bunch of items of media to a user, comprising:

a plurality of media item containers each containing a respective plurality of items of media having at least one common predetermined characteristic; and a controller configured to control at least one pick unit to selectively remove at least one item of media from at least two media item containers in a predetermined sequence; and wherein the predetermined sequence is either:

i) a configurable pick sequence determined responsive to the at least one common predetermined characteristic of each item of media; or ii) a default pick sequence;

and is selected responsive to a sensed condition; wherein the sensed condition is a state of a manual override flag; and if the manual override flag is set, items of media are picked in the configurable pick sequence, and if the manual override flag is not set, items of media are picked in the default pick sequence.

8. The apparatus as claimed in claim 7, wherein the at least one common predetermined characteristic comprises at least one dimension of each item of media.

9. The apparatus as claimed in claim 8, wherein the at least one dimension comprises an edge length of each media item.

10. A Self-Service Terminal (SST) comprising the apparatus as claimed in claim 7.

11. A method of presenting a bunch of items of media to a user, comprising:

selecting a plurality of items of media in a predetermined sequence responsive to at least one common predetermined characteristic of each item of media;

collating the selected items of media into a bunch of items of media; and presenting the bunch of items of media in a desired orientation to a user;

wherein the predetermined sequence is either:

i) a configurable pick sequence determined responsive to the at least one common predetermined characteristic of each item of media; or ii) a default pick sequence;

and is selected responsive to a sensed condition; wherein the sensed condition is a state of a manual override flag; and if the manual override flag is set, items of media are picked in the configurable pick sequence, and if the manual override flag is not set, items of media are picked in the default pick sequence.

* * * * *